United States Patent [19]

Pagliarini, Jr.

[11] Patent Number: 4,972,390

[45] Date of Patent: Nov. 20, 1990

[54] STACK DRIVEN FLEXURAL DISC TRANSDUCER

[75] Inventor: John A. Pagliarini, Jr., Ocean Bluff, Mass.

[73] Assignee: General Instrument corp., New York, N.Y.

[21] Appl. No.: 334,474

[22] Filed: Apr. 3, 1989

[51] Int. Cl.[5] ..... H04R 17/00

[52] U.S. Cl. ..... 367/158; 367/163; 310/337

[58] Field of Search ..... 367/157–165; 310/324, 328, 334, 337

[56] References Cited

U.S. PATENT DOCUMENTS

| | | | |
|---|---|---|---|
| 2,498,990 | 2/1950 | Fryklund | 310/324 |
| 2,962,695 | 11/1960 | Harris | 367/158 |
| 3,068,446 | 12/1962 | Ehrlich et al. | 367/158 |
| 3,094,636 | 6/1963 | Gould | 367/163 X |
| 3,113,288 | 12/1963 | Snavely | 367/163 |
| 3,137,836 | 6/1964 | Glover | 367/165 |
| 3,461,910 | 8/1969 | Selsom et al. | 310/334 |
| 4,384,351 | 5/1983 | Pagliarini, Jr. | 367/175 |
| 4,709,361 | 11/1987 | Dahlstrom et al. | 367/165 |
| 4,737,939 | 4/1988 | Ricketts | 367/158 |

OTHER PUBLICATIONS

Marshall et al., Advances in Flextensional Transducer Design Oceans, 1979, pp. 1–6.

Pagliorini, J. A., Small Wideband, Low-Frequency, High-Power Sound Source Utilizing Flextensional Concept., Oceans '78, pp. 1–6.

Woollett, R. S., Theory of Piezoplastric Flexual Disk Transducer w/Appli. to Underwater Sound, USL Research Report #490, 12/60 p. 1–76.

*Primary Examiner*—Brian S. Steinberger

*Attorney, Agent, or Firm*—James & Franklin

[57] ABSTRACT

The underwater sound projector includes a hollow-cylindrical metal housing having a recess with an opening. A non-ceramic flexural disc is supported over the opening. Within the recess is a stack of piezoelectric ring elements. A metal drive head transfers force axially from the stack to an annular area on the disc spaced from the center thereof. Foil electrodes are interposed between the piezoelectric rings and situated at the ends of the stack. A stress bolt clamp connects the drive head to the housing with the stack situated therebetween.

25 Claims, 4 Drawing Sheets

STACK DRIVEN FLEXURAL DISC TRANSDUCER

The present invention relates to sound transducers and more particularly to a stack driven flexural disc transducer designed for use as an underwater sound projector of a sonar system or the like.

Many sonar systems presently in use or currently under development employ a plurality of small, low frequency underwater sound sources. Transducers which incorporate flexural modes are particularly useful in this regard because they have the lowest frequency-to-size ratios. The present invention relates to such a transducer.

Transducers which incorporate a flextensional concept have been known in the art for many years. The principles of operation of such devices have been publicized, see papers on the flextensional transducer presented by my colleagues and me at the Oceans '78 and Oceans '79 meetings of the Marine Technology Society entitled: A Small, Wideband, Low Frequency, High Power Sound Source Utilizing The Flextensional Transducer Concept and Advances in Flextensional Transducer Design, respectively. Also, see U.S. Pat. No. 4,384,351, issued May 17, 1983 and entitled Flextensional Transducer and the patents cited therein, in this regard.

As described in those references, the flextensional transducer consists of a shell which, because of its shape and dimensions, has one or more resonant vibrational modes in the band of interest. A piezoelectric bar, situated within the shell, is used to excite the desired modes.

Another type of transducer which has been known in the art for many years is the piezoelectric flexural disc. The principles of operation of such a device have been publicized, see report entitled "Theory Of The Piezoelectric Flexural Disc Transducer With Applications To Underwater Sound" by R. S. Woollett, USL Research Report 490, Dec. 5, 1960, U.S. Navy Underwater Sound Laboratory, New London, Conn. In one form of the transducer, the disc is made of two layers of material, that is, it is bilaminar. One layer is a piezoelectric ceramic and will flex when an electric field is applied across it. This is because of the radial strains generated in the layer. If an A.C. voltage is applied, the disc will flex back and forth at the frequency of the applied voltage because the relative directions of the field and the material polarization are alternately the same or opposite.

Such a bilaminar disc, with wires attached to the two flat surfaces of the piezoelectric layer, can be coated with a flexible waterproof material to make it suitable for underwater use. When an A.C. voltage is applied between the two wires, the disc vibrates in flexure at the frequency of the applied voltage, its two flat surface radiating acoustic energy at the frequency. Because in any one instant of time the two radiating surfaces are flexing in opposite directions, the energy radiated by one surface is out of phase with and almost completely cancelled by the energy radiated by the other surface. In order to overcome the inefficiencies of such a device as a sound source, different configurations of multiple bilaminar discs have been employed.

There are three major disadvantages to using a conventional piezoelectric flexural disc as an underwater sound source, regardless of the particular configuration employed. This type of disc is unable to survive exposure to the high pressures which exist at great ocean depths. It is unable to survive exposure to an underwater explosion such as that from a depth charge, a severe drawback in military applications. It also has a high "Q" value, which limits the available operating frequency band width.

The inability to survive exposure to high pressures and underwater explosion is a result of the materials used. The best piezoelectric material which can be used in flexural discs is piezoelectric ceramic, because of its high electromechanical coupling coefficient. All ceramics, however, are brittle and can only survive very little shear before they fracture. Thus, they are unable to withstand high peak hydrostatic pressures.

The narrow operating band width of the device is a result of the high "Q" value. The mechanical "Q" value of a resonant mechanical device is a function of the ratio of the masses and velocities of the reactive components to the resistances and the velocities of the resistive components. In a flexural disc made of piezoelectric ceramic, which is a dense material, the ceramic is moving at a high velocity. The combination of high mass and high velocity results in a mechanical "Q".

The electrical "Q" value of a transducer is a function of the electromechanical coupling coefficient of the piezoelectric material. The coupling is highest when the direction of the electric field coincides with the direction of stress. In a piezoelectric flexural disc, however, the electric field is applied in a direction of the thickness of the disc (axially) while the stress which is causing the flexure is in the radial direction. Because these directions do not coincide, the coupling is low and consequently the electrical "Q" value is high. The combination of a high mechanical "Q" and a high electrical "Q" results in limited operating frequency band widths.

It is, therefor, a prime object of the present invention to provide a flexural disc transducer suitable for underwater use which has an increased ability to survive exposure to the high pressures.

It is another object of the present invention to provide a flexural disc transducer with increased ability to survive exposure to an underwater explosion and hence an enhanced applicability to meet military requirements.

It is another object of the present invention to provide a flexural disc transducer which is operable over a relatively wide frequency band width.

It is another object of the present invention to provide a flexural disc transducer in which the disc is driven by a stack of annular piezoelectric elements.

It is another object of the present invention to provide a stack driven flexural disc transducer which includes a disc of non-piezoelectric ceramic material.

In accordance with one aspect of the present invention, an underwater sound transducer is provided including a housing defining a recess with an opening. A non-ceramic flexural disc is situated over the opening and supported by the edge of the housing. Piezoelectric elements are situated within the recess. Drive means are provided to operably connect the piezoelectric elements and the disc. Means are also provided for applying a potential difference across the piezoelectric means.

The disc is composed of an inert material. Preferably, the material is metal.

The housing has a generally hollow cylindrical configuration. The housing has a rim which is the edge upon which the disc is supported. Preferably, the housing is also made of a metal.

Edge support means are interposed between the housing edge and the disc. The edge support means preferably comprises an edge support ring.

The piezoelectric elements preferably comprise a piezoelectric ceramic ring. More preferably, the piezoelectric elements comprise an axially aligned plurality or stack of piezoelectric ceramic rings.

The potential difference applying means preferably comprises a plurality of foil electrodes. The electrodes are situated between the individual rings and on both ends of the stack.

The drive means preferably comprises means for abutting the disc in an area spaced from the center of the disc means. Preferably, the abutting means comprises annular force transfer means.

Means for maintaining the piezoelectric elements under a compressive force is provided. Preferably, the force maintaining means includes a stress bolt adapted to clamp the drive means to the housing with the piezoelectric elements sandwiched therebetween.

A flexible covering is preferably provided over the drive means. In addition, means for affixing the covering to the exterior surface of the housing is provided.

In a second embodiment, the housing is provided with a second opening. A second non-ceramic disc is supported over the second opening by the opposite edge of the housing. Second drive means operably connect the piezoelectric elements and the second disc.

In accordance with another aspect of the present invention, an underwater sound transducer is provided. The transducer includes a substantially cylindrical housing having a recess with an opening defined by a rim. A non-ceramic flexural disc is supported over the opening by the rim. Piezoelectric means are situated within the recess and include a stack of annular piezoelectric elements. Drive means operably connect the piezoelectric elements and the disc. The drive means abuts the disc in an area spaced from the center thereof. A plurality of foil electrodes are situated between the piezoelectric elements and on both sides of the stack.

To these and such other objects which may hereinafter appear, the present invention relates to a stack driven flexural disc transducer as described in the following specification taken together with the accompanying drawings wherein like numerals refer to like parts and in which.

In general, the present invention substitutes a non-ceramic flexural disc for the conventional bilaminar disc which includes a piezoelectric ceramic layer. The piezoelectric means is separated from the disc. The force developed by the expansion of the piezoelectric means when a voltage is applied thereto is transferred to the disc in a way which amplifies the force to obtain a mechanical advantage. This is accomplished by transferring the force to the disc in an axial direction but at a point thereon which is spaced from the center of the disc. Moving the drive point away from the center of the disc provides a good mechanical impedance match between the driver and the disc and at the same time results in an increase in the deflexion amplitude at the drive point. This is particularly useful in high power, low frequency projectors which require large deflections.

It is known that higher electromechanical coupling, and hence wider band width, can be achieved by increasing the volume of the piezoelectric ceramic elements. I have therefore elected to separate the piezoelectric ceramic from the disc because the disc should have as little mass as possible. To further optimize the coupling, a plurality of piezoelectric ceramic blocks may be used to drive spaced points along an annulus on the surface of the disc. However, this is cumbersome. I have therefore elected to use a single piezoelectric ceramic cylinder or tube coupled to the disc by a drive ring which contacts the disc in an annular area spaced from the disc center.

To decrease the impedance as much as possible, I have configured the ceramic tube out of a plurality of aligned piezoelectric ceramic annular elements or rings, stacked to form an assembly. Foil electrodes are provided between the rings and on both ends of the stack. In this manner, an axially directed electrical field is achieved, resulting in high coupling. At the same time, the electrical impedance is low because the electrodes are close together and because the rings are wired in parallel.

Figure 1:
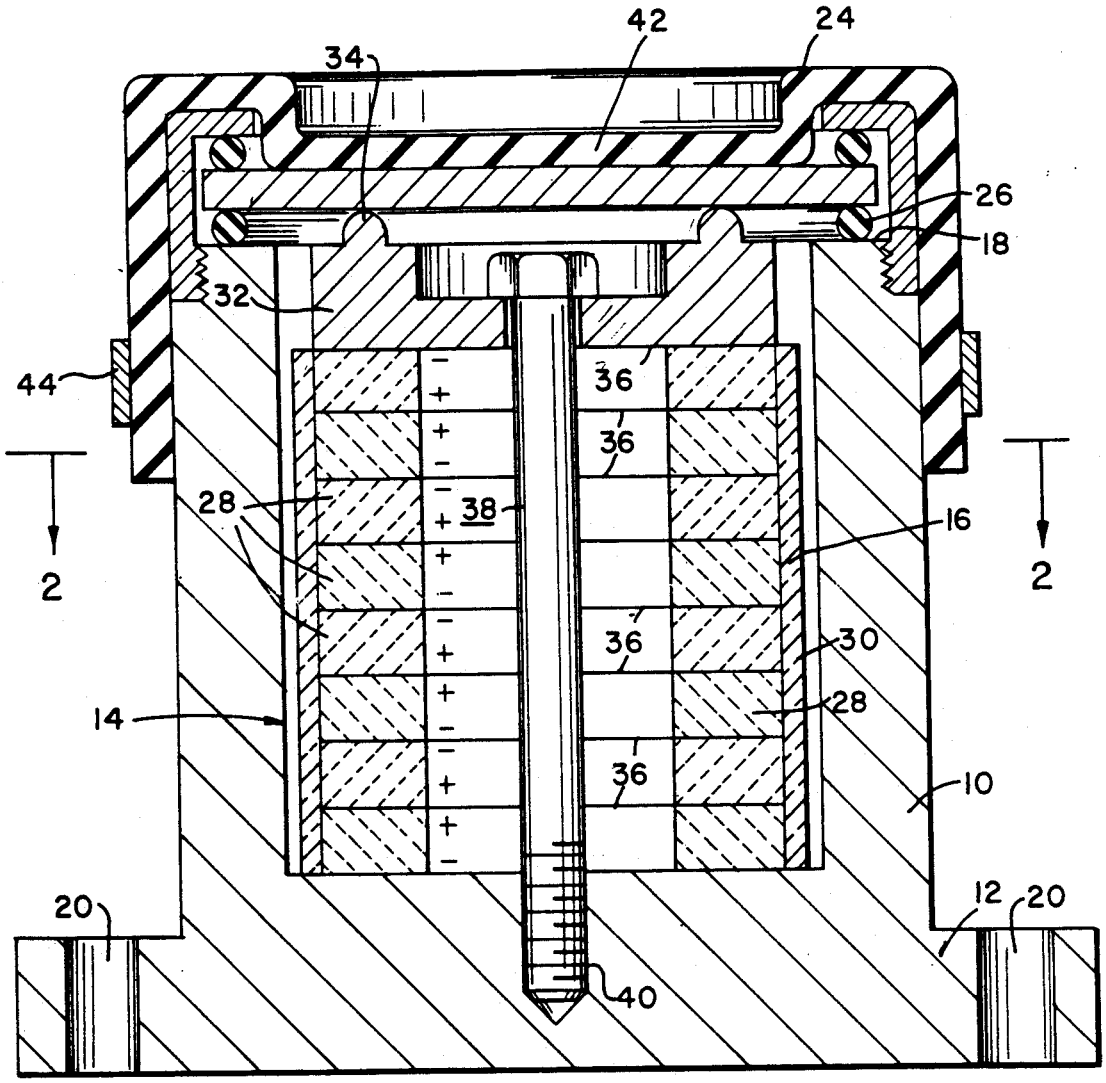
FIG. 1 is a cross-sectional view of a first preferred embodiment of the stack driven flexural disc transducer of the present invention.
Figure 2:
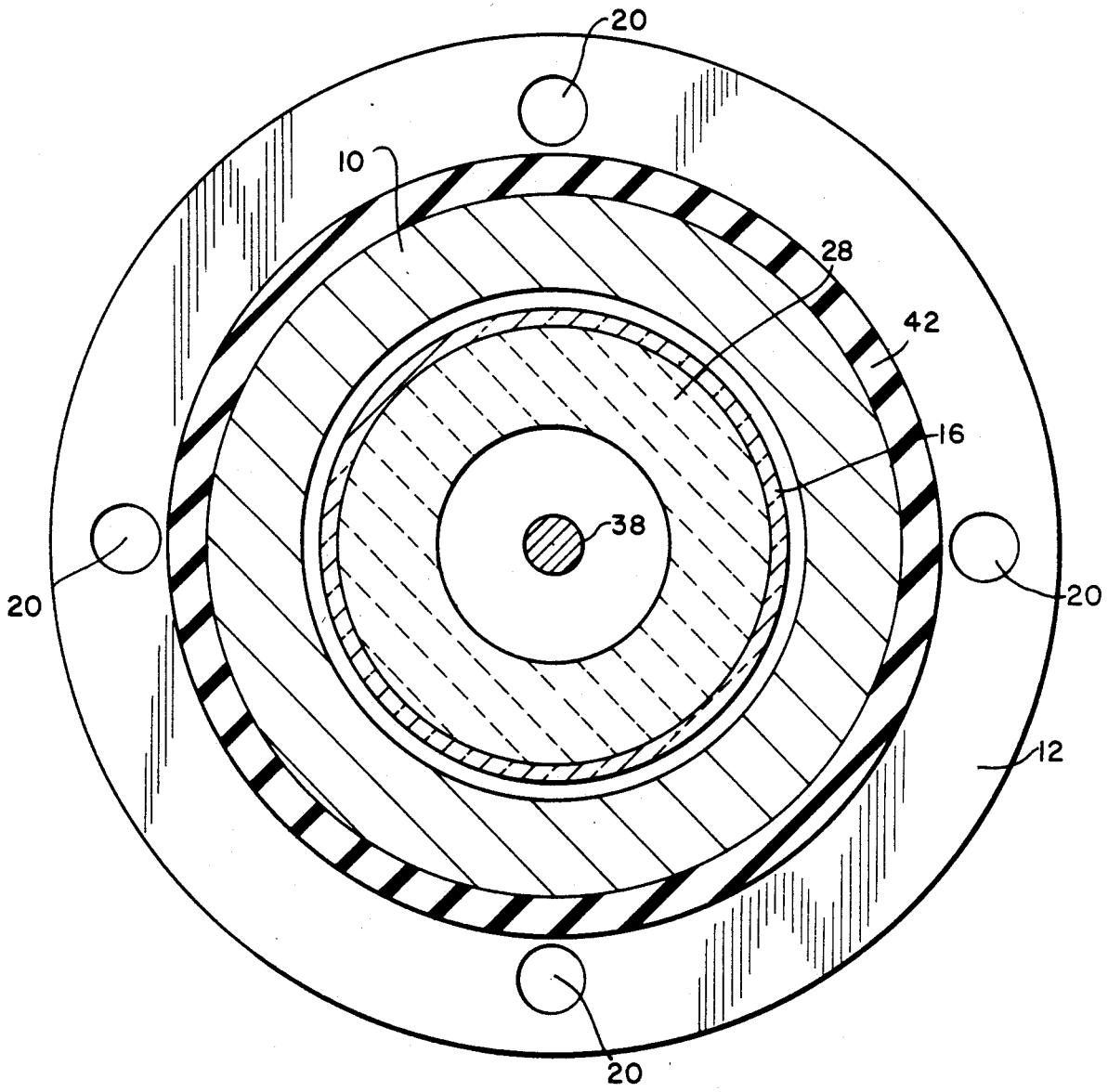
FIG. 2 is a cross-sectional view of the first preferred embodiment of the present invention taken along line 2—2 of FIG. 1.

As seen in FIGS. 1 and 2, the first preferred embodiment of the transducer of the present invention includes a generally cylindrical hollow housing 10 which includes a base 12. A generally cylindrical recess 14 is defined by cylindrical wall 16 having an upper edge or rim 18. Housing 10 is preferably composed of metal. Base 12 is provided with openings 20, to accept screws or other fastening devices for mounting the transducer.

A non-ceramic flexural disc 24, preferably made of an inert material such as metal, is situated over the opening in housing 10 and is supported by an edge support ring 26 interposed between rim 18 and an annular area spaced a short distance from the peripheral edge of disc 24. The edge support ring 26 is made of a material of high axial stiffness and low radial stiffness to allow disc 24 to flex freely in the desired flexural mode.

Within recess 14 is situated the piezoelectric ceramic means which comprises a plurality or stack of aligned piezoelectric ceramic annular elements or rings 28, eight of which are shown. Preferably, a fiberglass wrap 30 is situated within the space between the piezoelectric rings 28 and the interior surface of wall 16 of housing 10.

Atop the piezoelectric stack 28 is a drive ring 32 which is also preferably comprised of metal. On the top surface of drive head 32 is an annular drive element 34. The drive element 34 is the only portion of drive head 32 which is contact with the surface of disc 24. Element 34, like ring 26, must have a high axial stiffness and a low radial stiffness to allow all the axial force of the driver to act on the disc.

Interposed between rings 28 are foil electrodes 36. Foil electrodes 36 are also situated at both ends of the stack 28. The electrodes are connected to a source of electric potential, not shown. With the polarities and wiring as shown in FIG. 1, the electric field which results is axial. The electric impedance is low because electrodes 36 are close together and because the rings are wired in parallel.

Figure 3:
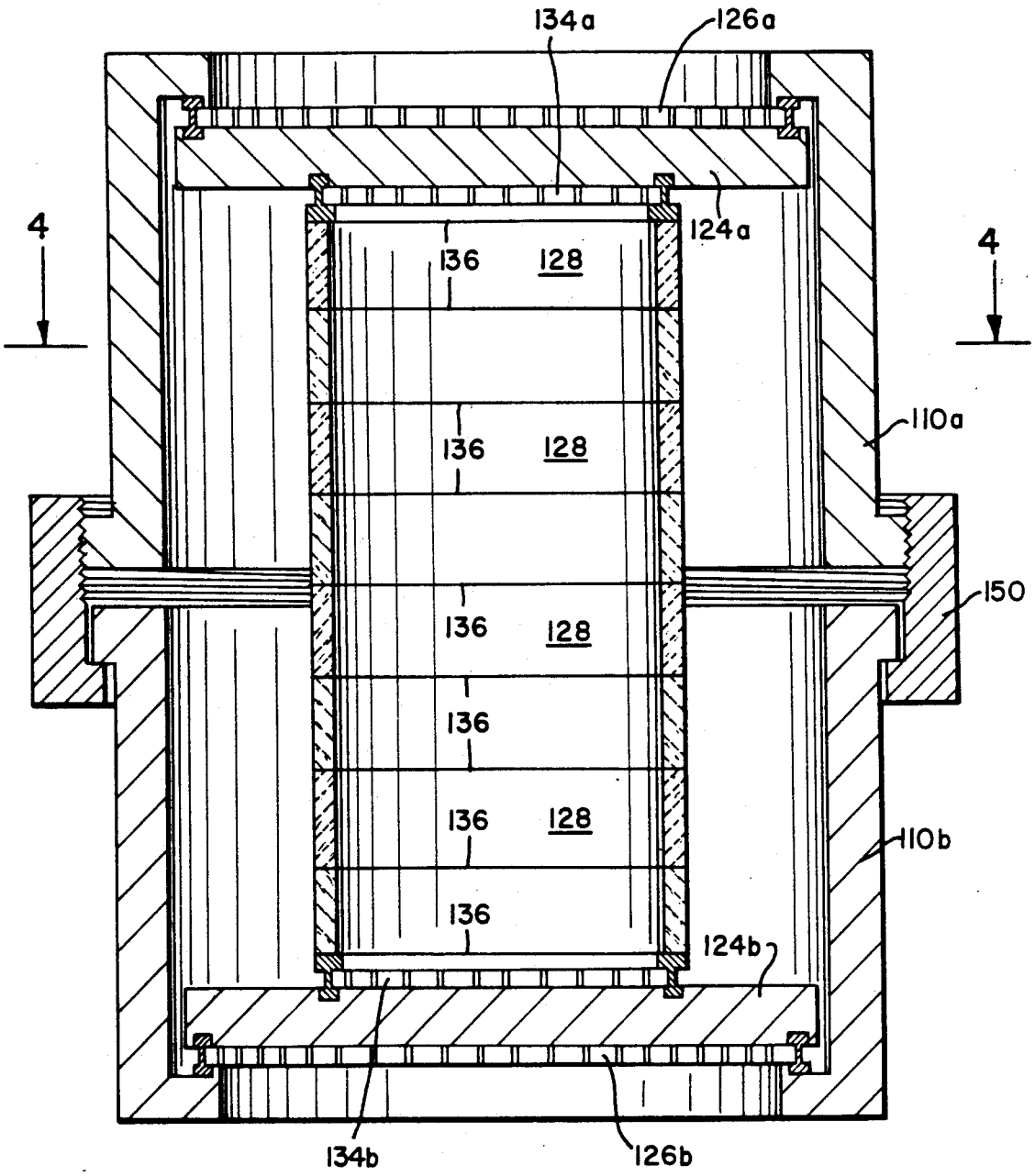
FIG. 3 is a cross-sectional view of a second preferred embodiment of the stack driven flexural disc transducer of the present invention.

Fiberglass wrap 30, noted above, provides the additional function of radially precompressing the piezoelectric rings 28 prior to transducer assembly. Axial precompression can be obtained by connecting the drive head 34 to the base 12 of housing 10, as shown in FIG. 1, or by splitting the housing into bottom and top halves, as shown in FIG. 3. The stress bolt must be designed to have the ability to apply a large amount of compression without adding much stiffness. Therefore, a high-strength steel or similar material is used for the bolt. Too much stiffness would clamp the assembly and restrict the desired motion. The combination of radial and axial compression of the piezoelectric elements results in a large increase in the capability of the transducer to survive ocean depths and underwater explosion shock, since ceramic is very strong under compression.

In the first preferred embodiment, a stress bolt 38 is provided with an enlarged head. The shaft of the bolt passes through a central opening in drive head 32. The end of the bolt is externally threaded so as to be received in an internally threaded hole 40 in base 10. In this way, the piezoelectric stack is compressed between the drive head and the housing to an extent determined by the position of the bolt.

Preferably, a flexible rubber covering 42 is stretched over the top of housing 10. Covering 42 is secured by band 44 or the like to the housing to ensure a watertight seal.

Figure 4:
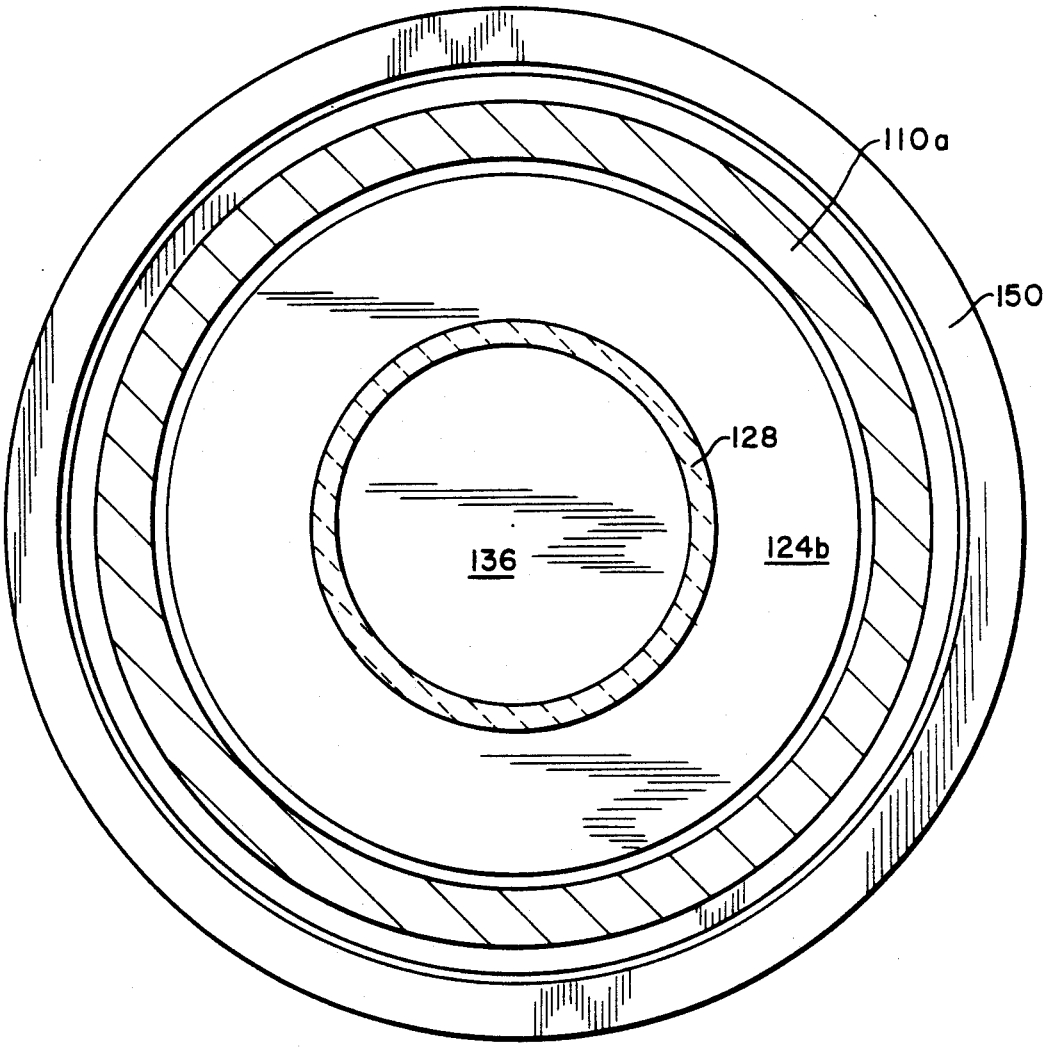
FIG. 4 is a cross-sectional view of the second preferred embodiment of the present invention taken along line 4—4 of FIG. 3.

FIGS. 3 and 4 show a second, double-ended embodiment of the transducer of the present invention. In this case, housing 110 is entirely cylindrical with openings at both ends and no base. Discs **124*a* and 124*b*, of identical structure to disc 24, are situated at both ends of the housing, aligned with the respective openings. The discs are spaced from the rim of the housing by support rings 126*a* and 126*b* which are slotted to increase flexibility. A stack of annular piezoelectric elements 128 is provided with foil electrodes 136 interposed therebetween and at each end thereof. Each end of the stack 128 is connected to the respective disc 124 by a slotted drive ring 134*a* and 134*b*, respectively. The upper portion of the housing 110*a* and the lower portion 110*b* are externally threaded and connected by an internally threaded nut 150 to provide the desirable axial precompression. During final assembly, the transducer is placed in a hydraulic press and a predetermined axial impression applied as the housing halves are secured by nut 150**. All materials are identical to those of the first embodiment. Banded coverings (not shown) may be employed, if desirable.

This double sided version has the additional advantage of symmetry which results in a more omnidirectional radiation pattern, desirable in certain applications. It also has the advantage of reducing housing motion since the symmetry results in a virtual plane of zero motion through the center of the transducer. Housing motion can cause slight changes in acoustic performance which are sometimes undesirable.

A housing of increased mass is sometimes used to prevent housing motion in a single ended transducer such as the first preferred embodiment. However, a lighter housing can be used in a double ended version, such as in the second preferred embodiment.

It should now be appreciated that the present invention relates to a stack driven flexural disc transducer which utilizes a non-piezoelectric ceramic disc mechanically separated from a stack of annular piezoelectric ceramic elements. This configuration results in the transducer which has increased ability to survive exposure to high pressures which exist at great ocean depths and an increased ability to survive exposure to underwater explosion. At the same time, the transducer of the present invention has a relatively wide operating frequency band width.

While only a limited number of the preferred embodiments have been disclosed herein, it is obvious that many variations and modifications could be made thereto. It is intended to cover all of these variations and modifications which fall within the scope of the present invention as defined by the following claims:

I claim:

1. An underwater sound transducer comprising a housing having a recess with an opening defined by the edge of the housing, non-ceramic flexural disc means situated over said opening and supported by said edge of said housing, piezoelectric means situated within said housing, drive means interposed between and operably connecting said piezoelectric means and said disc means, said drive means comprising a substantially cylindrical drive ring and an annular drive element, said annular drive element being interposed between said drive ring and said flexural disc.

2. The transducer of claim 1 wherein said disc means is composed of inert material.

3. The transducer of claim 1 wherein said disc means is composed of a metal.

4. The transducer of claim 1 wherein said housing means has a generally hollow cylindrical configuration.

5. The transducer of claim 1 wherein said housing has a rim and wherein said rim is said edge upon which said disc means is supported.

6. The transducer of claim 1 wherein said housing is composed of metal.

7. The transducer of claim 1 further comprising edge support means interposed therebetween said edge and said disc means.

8. The transducer of claim 7 wherein said support means comprises an edge support ring.

9. The transducer of claim 1 wherein said piezoelectric means comprises a piezoelectric ring.

10. The transducer of claim 1 wherein said piezoelectric means comprises a stack of aligned piezoelectric rings.

11. The transducer of claim 10 wherein said potential difference applying means comprises a plurality of foil electrodes situated between said rings and on both ends of said stack.

12. The transducer of claim 10 wherein said potential difference applying means comprises electrode means adapted to energize said rings in parallel.

13. The transducer of claim 1 wherein said drive means comprises means for abutting said disc means in an area spaced from the center of said disc means.

14. The transducer of claim 13 wherein said abutting means comprises annular force transfer means.

15. The transducer of claim 1 further comprising means for maintaining said piezoelectric means under a compressive force.

16. The transducer of claim 15 wherein said force maintaining means comprises a stress bolt adapted to connect said drive means to said housing with said piezoelectric means therebetween.

17. The transducer of claim 1 further comprising a flexible covering over said disc means and means for affixing said covering to the exterior surface of said housing.

18. The transducer of claim 1 wherein said housing has a second opening, second non-ceramic disc means supported by the opposite edge of said housing and second drive means operably connecting said piezoelectric means and said second disc means.

19. The transducer of claim 18 wherein said housing means has a generally hollow cylindrical configuration.

20. The transducer of claim 18 wherein said piezoelectric means comprises a piezoelectric ring.

21. The transducer of claim 20 wherein said piezoelectric means comprises a stack of piezoelectric rings.

22. The transducer of claim 21 wherein said potential difference applying means comprises a plurality of foil electrodes situated between said rings and on both ends of said stack.

23. The transducer of claim 21 where said potential difference applying means comprises electrode means adapted to energize said rings in parallel.

24. The transducer of claim 18 further comprising means for maintaining said piezoelectric means under a compressive force.

25. The transducer of claim 1 wherein said drive ring has an opening therein and further comprising a stress bolt extending through said opening in said drive ring for connecting same to said housing.

* * * * *